US008998639B2

(12) United States Patent
Kida et al.

(10) Patent No.: US 8,998,639 B2
(45) Date of Patent: Apr. 7, 2015

(54) BOARD CONNECTOR WITH ANCHOR TAB

(71) Applicant: Yazaki Corporation, Tokyo (JP)

(72) Inventors: Kousuke Kida, Makinohara (JP); Shinichi Ikemoto, Yokohama (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/012,486

(22) Filed: Aug. 28, 2013

(65) Prior Publication Data

US 2014/0065887 A1 Mar. 6, 2014

(30) Foreign Application Priority Data

Aug. 31, 2012 (JP) ..... 2012-192360

(51) Int. Cl.

| | |
|---|---|
| ***H01R 13/60*** | (2006.01) |
| ***H01R 13/46*** | (2006.01) |
| ***H01R 12/70*** | (2011.01) |
| ***H01R 12/72*** | (2011.01) |

(52) U.S. Cl.

CPC ..... *H01R 13/46* (2013.01); *H01R 12/7029* (2013.01); *H01R 12/707* (2013.01); *H01R 12/724* (2013.01)

(58) Field of Classification Search

USPC ..... 439/569, 570

See application file for complete search history.

(56) References Cited

U.S. PATENT DOCUMENTS

2009/0117778 A1* 5/2009 Sakamoto ..... 439/569

FOREIGN PATENT DOCUMENTS

JP 2005-253176 A 9/2005

* cited by examiner

*Primary Examiner* — Tho D Ta

(74) *Attorney, Agent, or Firm* — Sughrue Mion, PLLC

(57) ABSTRACT

There is provided a board connector that prevents loads due to thermal changes in a connector housing from being directly imposed on soldered areas of anchor hardware and that enhances anchoring reliability of the anchor hardware. A board connector includes a connector housing to be populated on a circuit board, anchor hardware for soldering the connector housing to the circuit board, holding grooves that are formed on the connector housing and capable of press-fitting and holding upper lugs of the anchor hardware, and tapered portions that are formed in the respective holding grooves and that guide the upper lugs of each of the pieces of press-fitted anchor hardware in a direction away from each side surface of the connector housing, thereby creating clearance S between the anchor hardware and respective opposing side surfaces of the connector housing.

2 Claims, 9 Drawing Sheets

BOARD CONNECTOR WITH ANCHOR TAB

TECHNICAL FIELD

The invention relates to a board connector.

BACKGROUND ART

A technique for preventing occurrence of cracking in soldered areas (solder fillets) that connect tabs of a bus bar to a conductor of a printed board by forming a support member of a printed board (a circuit board) from a metallic material similar to that of the bus-bars has hitherto been known (see Patent Document 1).

As shown in FIG. 9, in an electric connection box using the technique, the tabs are caused to protrude from a flat bus bar 501 housed in a case, thereby connecting a conductor of the printed board 503 positioned above the flat bus bar 501 to the flat bus bar 501. Conductor connection tabs 505 and a board anchor tab 507 are caused to protrude from the flat bus bar 501. The conductor connection tabs 505 are inserted into respective first insertion holes 509 of the board, and the board anchor tab 507 is inserted into a second insertion hole 511. The conductor connection tabs 505 are soldered to the conductor of the printed board 503, and the board anchor tab 507 is also soldered to the printed board 503, thereby supporting the printed board 503.

A support member of the printed board 503 is formed from a metallic material analogous to that of the connection tabs of the flat bus bar 501, and the thus-formed support member is taken as the board anchor tab 507. Accordingly, the conductor connection tabs 505 to be connected to the conductor of the printed board 503 and the board anchor tab 507 that supports the printed board 503 can be made identical with each other in terms of a coefficient of thermal expansion. The conductor connection tabs 505 and the board anchor tab 507 are similarly inflated by thermal changes, whereby the printed board 503 secured to the board anchor tab 507 can be caused to follow inflation of the conductor connection tabs 505. Therefore, occurrence of cracking, which would otherwise arise when loads are imposed on soldered areas that connect the conductor connection tabs 505 to the conductor of the printed board 503, can be prevented.

RELATED ART DOCUMENT

Patent Document

[Patent Document 1] JP-A-2005-253176

SUMMARY OF THE INVENTION

Problem that the Invention is to Solve

Incidentally, in the case of an SMT (Surface Mounting Technology) connector (a board connector) in which a connector housing is soldered to a conductor of a circuit board by way of anchor hardware, like pegs, and further to the circuit board, loads are imposed directly on soldered areas between the conductor of the circuit board and the anchor hardware even for reasons of a difference in a coefficient of linear expansion of the circuit board and a coefficient of linear expansion of the connector housing, which originates from temperature changes. Specifically, when an inflated size of the connector housing is larger than an inflated size of the circuit board, dimensional changes commensurate with the difference occur in an exterior surface of the connector housing, which imposes loads directly on the soldered areas where the connector housing is soldered by way of the anchor hardware. When a temperature cycle is added to the solder anchors for a long period of time, cracking occurs in the soldered areas, which may cause deterioration of peel strength or a conduction failure. This raises a problem of deterioration of anchoring reliability of the anchor hardware of the board connector.

The invention has been conceived in light of the circumstance and aims at providing a board connector that prevents loads induced by thermal changes in a connector housing from being imposed directly on soldered areas of anchor hardware and that enhances anchoring reliability of the anchor hardware.

Means for Solving the Problem

The object described above is achieved by the following constitutions.

(1) A board connector comprising:

a connector housing to be populated on a circuit board; anchor hardware for soldering the connector housing to the circuit board;

a press-fit attachment portion that is formed on either side surface of the connector housing and that enables press-fitting and holding a press-fit portion of the anchor hardware; and a tapered portion that is formed in the press-fit attachment portion and that guides the press-fit portion of the press-fitted anchor hardware in a direction away from the side surface of the connector housing, thereby creating clearance between the anchor hardware and opposing side surface of the connector housing.

In relation to the board connector with the configuration described in connection with (1), when the press-fit portion of the anchor hardware is press-fitted into the press-fit attachment portions formed on either side of the connector housing, the anchor hardware is guided (deviated) in a direction away from the side surface of the connector housing by means of the tapered portions, whereby the press-fit portion is press-fitted and held. To be specific, the anchor hardware is press-fitted and held in the connector housing while thoroughly separated from either side surface of the connector housing. Accordingly, even when an inflated size of the connector housing is larger than an inflated size of the circuit board and when dimensional changes commensurate with the difference occur in either side surface of the connector housing on the occasion of the solder anchor of the anchor hardware being soldered to the conductor of the circuit board and, by extension, the board connector being thereby populated on the circuit board, dimensional changes commensurate with a difference due to a discrepancy, which originates from the temperature changes, between a coefficient of linear expansion of the circuit board and a coefficient of linear expansion of the connector housing can be absorbed by means of clearance existing between either side surface of the connector housing and the anchor hardware. Thus, loads can be prevented from be imposed directly on soldered areas between the conductor of the circuit board and the anchor hardware.

(2) The board connector according to the above (1), wherein the anchor hardware has a flat main body, a pair of upper lugs each of which is taken as the press-fit portion by causing an upper side of the main body to protrude in a widthwise direction, and a solder anchor made by folding a lower side portion of the main body in a thicknesswise direction of a plate;

the press-fit attachment portion is made up of a pair of holding grooves that extend in a direction orthogonal to an upper surface of the circuit board in order to press fit and hold the pair of upper lugs and that open while opposing each other; and the tapered portion formed in each of the respective holding grooves guide each of the upper lugs in a direction in which the upper lugs are pushed against an outside inner wall surface.

In the board connector with the configuration described in connection with (2), the pair of upper lugs provided along the upper side of the main body are taken as a press-fit portion of anchor hardware. The press-fit portion can thereby keep a distance from the solder anchor provided along the lower side of the main body. Accordingly, dimensional changes due to a discrepancy, which originates from temperature changes, between a coefficient of linear expansion of the circuit board and a coefficient of linear expansion of the connector housing can be effectively absorbed by elastic deformation of the main body.

Advantages of the Invention

In the board connector of the invention, loads induced by thermal changes in connector housing are not imposed directly on the soldered areas of the anchor hardware, so that anchoring reliability of the anchor hardware can be enhanced.

The invention has been briefly described thus far. Moreover, details of the invention will become more clarified by reading through a mode for implementing the invention to be described below (hereinafter called an "embodiment") by reference to the accompanying drawings.

EMBODIMENT FOR IMPLEMENTING THE INVENTION

An embodiment of the invention is hereunder described by reference to the drawings.

A board connector 11 of the embodiment can be used preferably as a so-called SMT connector to be populated on a circuit board 13 that is to be housed in electronic equipment, like an ECU.

Figure 1:
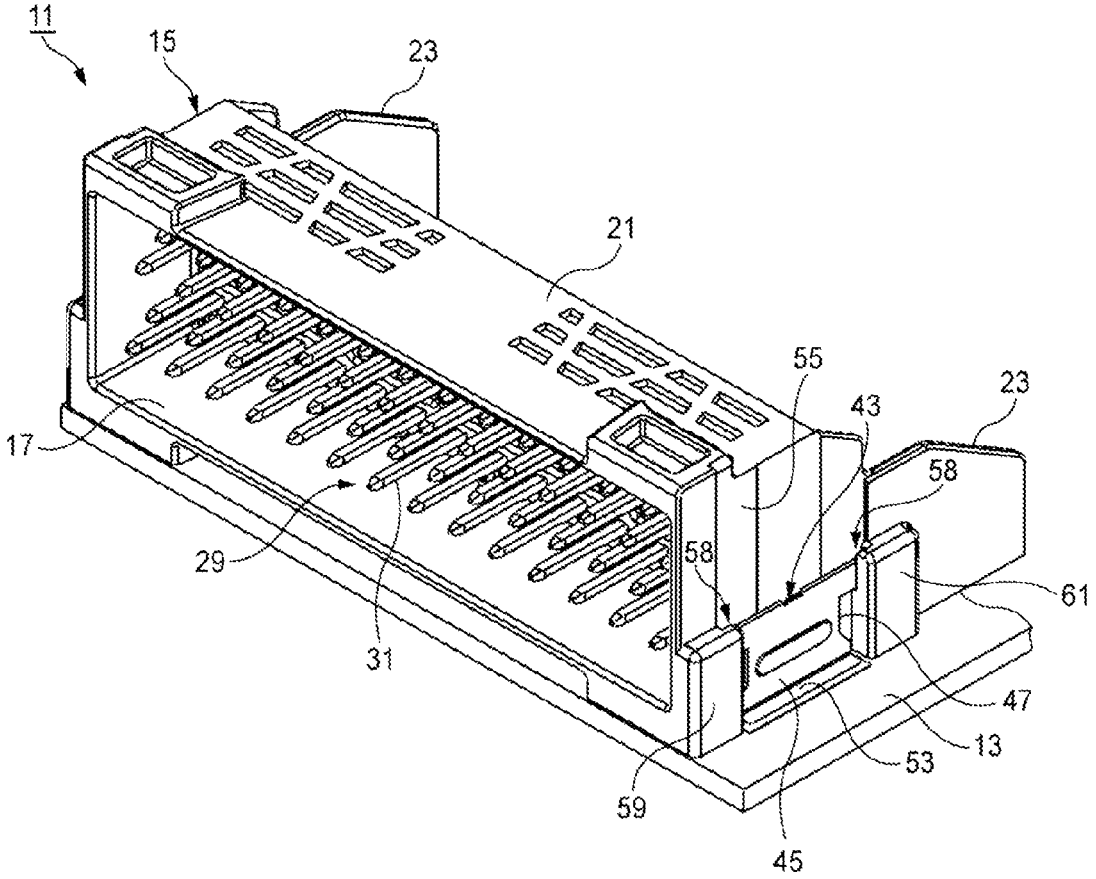
FIG. 1 is a perspective view showing that a board connector of an embodiment of the invention is populated on a circuit board.

As shown in FIG. 1, the board connector 11 has a connector housing 15 to be populated on the circuit board 13 and anchor hardware 43 for soldering the connector housing 15 to the circuit board 13.

Figure 4A:
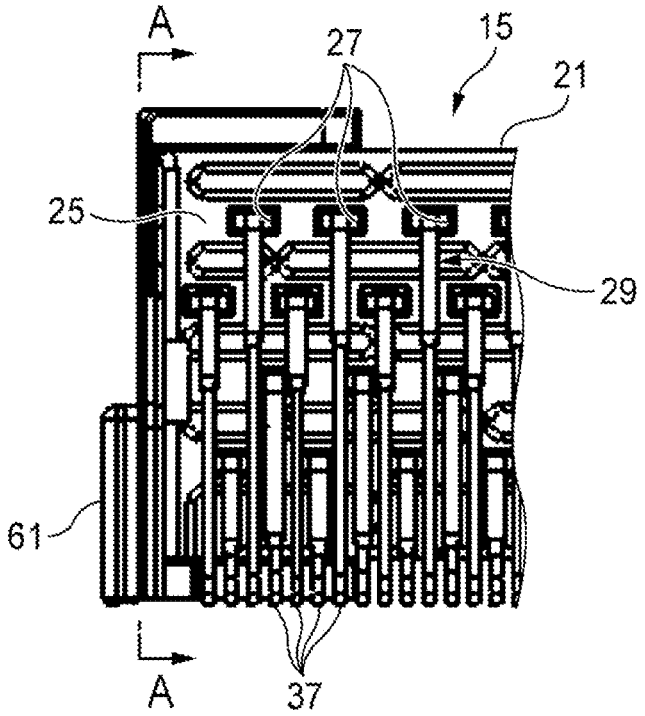
FIG. 4A is a partially cutaway rear view of the connector housing shown in FIG. 2.
Figure 4B:
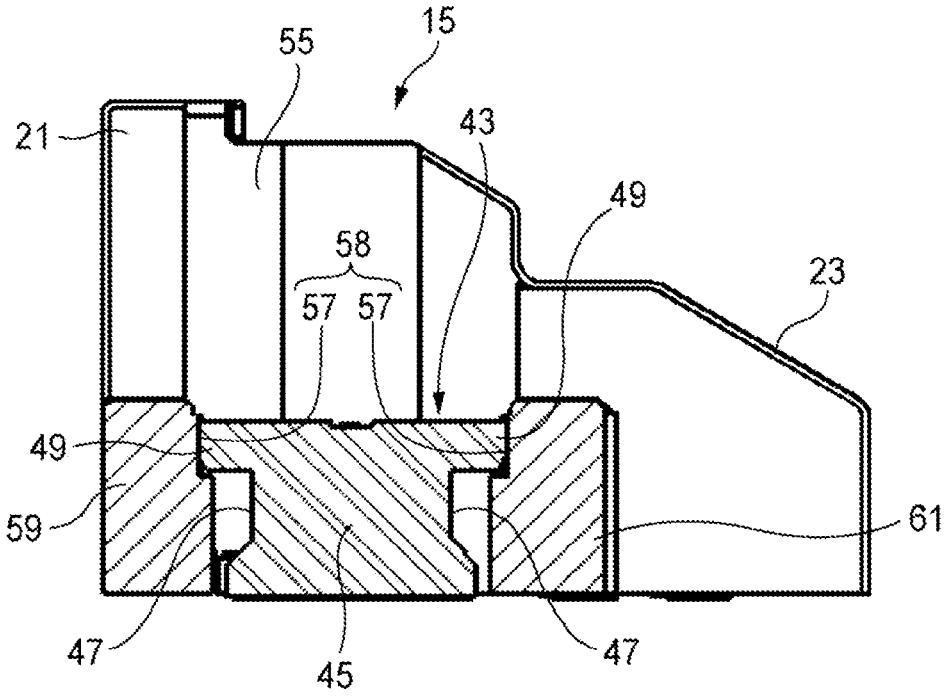
FIG. 4B is a cross sectional view taken along an imaginary line between arrowy heads A shown in FIG. 4A.
Figure 6:
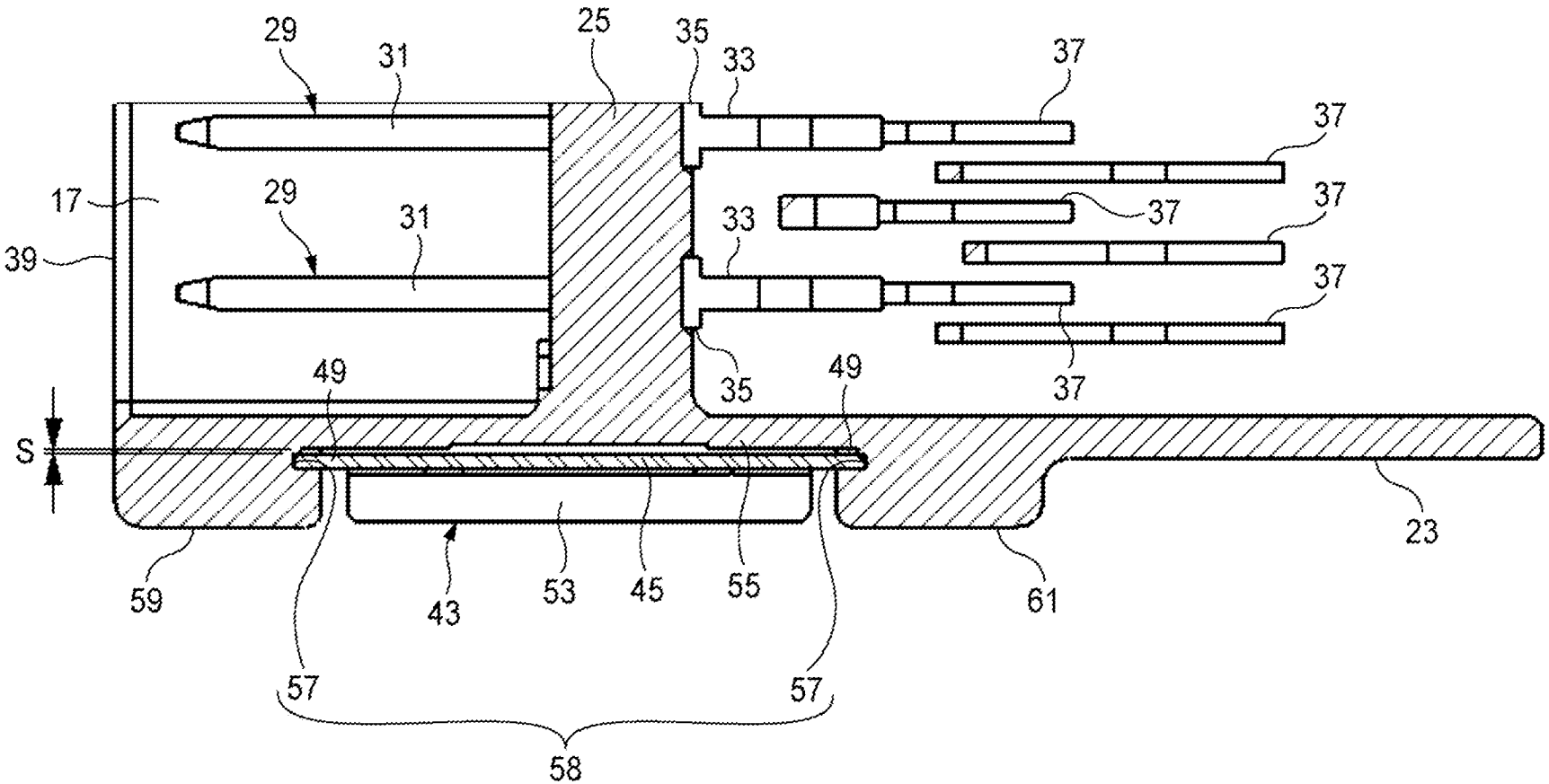
FIG. 6 is a cross sectional view taken along an imaginary line between arrowy heads B-B shown in FIG. 5.

The connector housing 15 is formed from a synthetic resin and into a shape of a rectangular parallelepiped, and a fitting recess 17 that receives an unillustrated counterpart connector is formed on a front side of a housing body 21. A pair of parallel protective walls 23 are projectingly formed in a rearward direction along respective lateral edges that are on the other side of the fitting recess 17. A terminal holding portion 25 (see FIG. 6) is formed in the housing body 21. A plurality of terminal holding holes 27 (see FIGS. 4A and 4B) are formed, while being arranged side by side, in multiple rows in the terminal holding portion 25. In the embodiment, male terminals 29 are inserted into the respective terminal holding holes 27.

Each of the male terminals 29 has at its leading end a male tab 31. The individual male terminal 29 is continually, serially followed by a terminal 33 (see FIG. 6), an insertion stopper 35, and a lead 37. The male terminals 29 are made by punching a raw metal plate in one by means of thin plate working. The male terminal 29 is arranged in numbers in the terminal holding portion 25. Leading ends 41 of the respective male terminals 29 arranged in the terminal holding portion 25 protrude toward an opening 39 of the press-fit recess 17 provided in the connector housing 15.

The male terminals 29 are press-fitted into the respective terminal holding holes 27 of the terminal holding portion 25. In each of the thus-press-fitted male terminals 29, the lead 37 drawn from the terminal holding hole 27 is positioned parallel to the circuit board 13. The leads 37 are soldered to a conductor 14 laid on the circuit board 13. The pair of protective walls 23 are positioned, one protective wall positioned at one end and the other protective wall positioned at the other end of a row of leads 37.

Even when the leads 37 of the plurality of male terminals 29 press-fitted into the terminal holding portion 25 are soldered to the circuit board 13, the connector housing 15 becomes anchored to the circuit board 13. However, in order to prevent insertion force exerted to the counterpart connector from acting directly on potions of the leads 37 anchored to the board, the connector housing 15 is also anchored directly to the circuit board 13 even by means of the anchor hardware 43.

Figure 2:
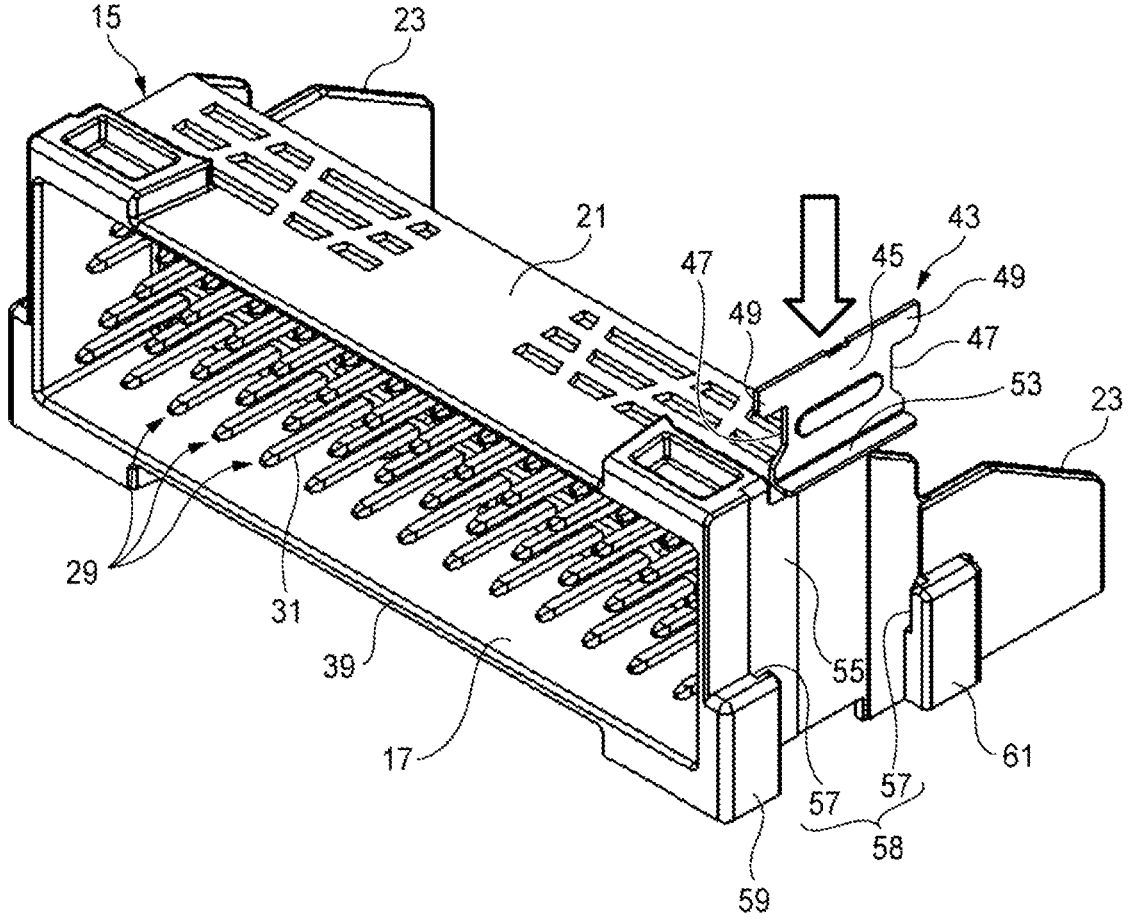
FIG. 2 is an exploded perspective view of the board connector shown in FIG. 1 before anchor hardware is press-fitted into the board connector.
Figure 3:
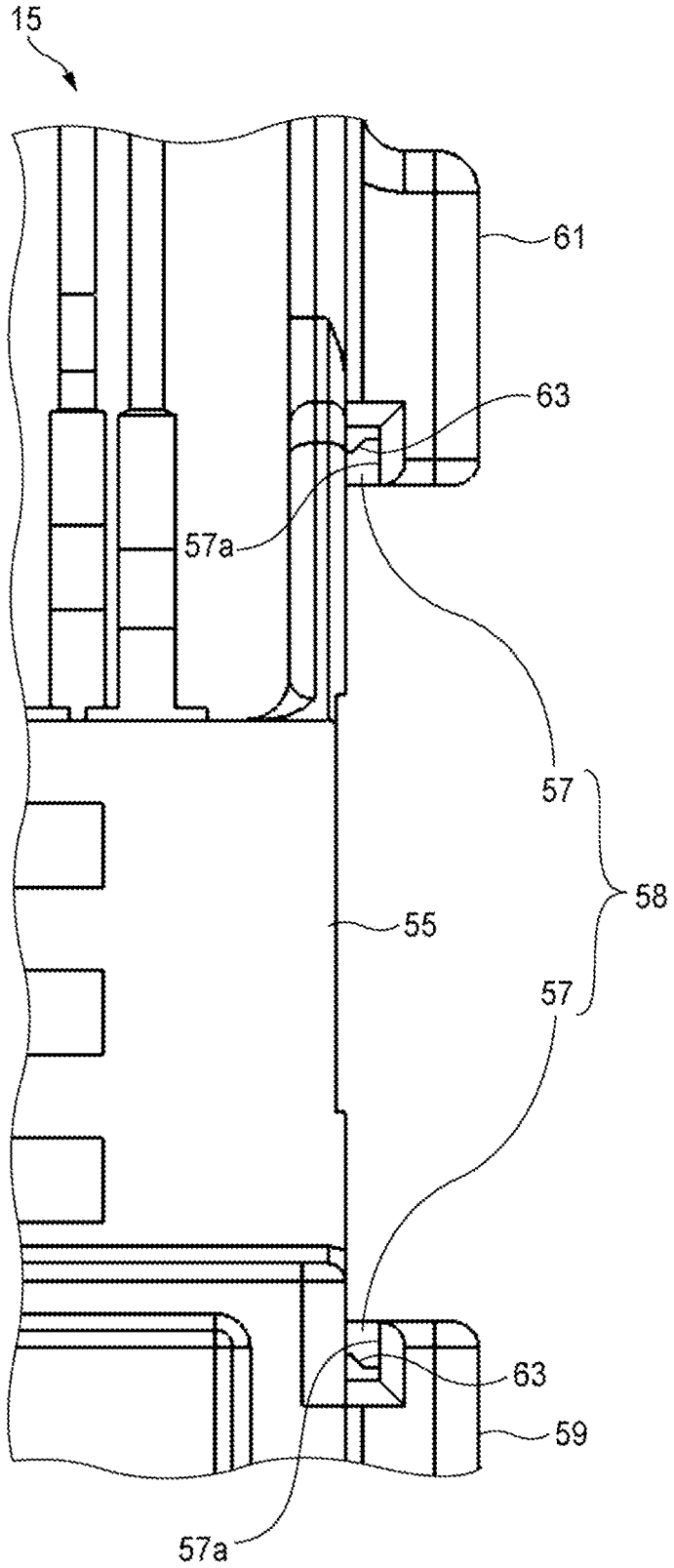
FIG. 3 is an enlarged plan view of press-fit attachment portions provided in the connector housing.

The anchor hardware 43 is formed from a metallic plate that exhibits a spring characteristic. In the anchor hardware 43, inwardly indented cutouts 47 are formed in a pair of respective vertical sides of a main body 45 (see FIG. 4B) formed like a rectangular plate. The main body 45 made by the notches 47 has a pair of upper lugs 49 that are formed as a press-fit portion by means of letting an upper-side portion of the main body protrude in a widthwise direction (i.e., a horizontal direction in FIG. 2) and a solder anchor 53 that is made by folding a lower side of the main body 45 outside (see FIG. 1) in parallel with the circuit board 13 (i.e., toward the other side of the connector housing 15).

In the meantime, press-fit attachment portions 58 capable of press-fit holding the upper lugs 49 of the anchor hardware 43 are provided on either side surface 55 of the connector housing 15 (either side surface when the connector housing 15 is viewed along a direction in which the male terminals 29 are arranged). The press-fit attachment portions 58 are formed such that one is in a front-side hardware fixing portion 59 and the other is in a rear-side hardware fixing portion 61 which are formed as a pair so as to protrude in both front and rear directions from either side surface 55 of the connector housing 15. The press-fit attachment portions 58 are formed from a pair of holding grooves 57 that extend in a direction orthogonal to an upper surface of the circuit board 13 and that are opened while opposing each other.

Figure 5:
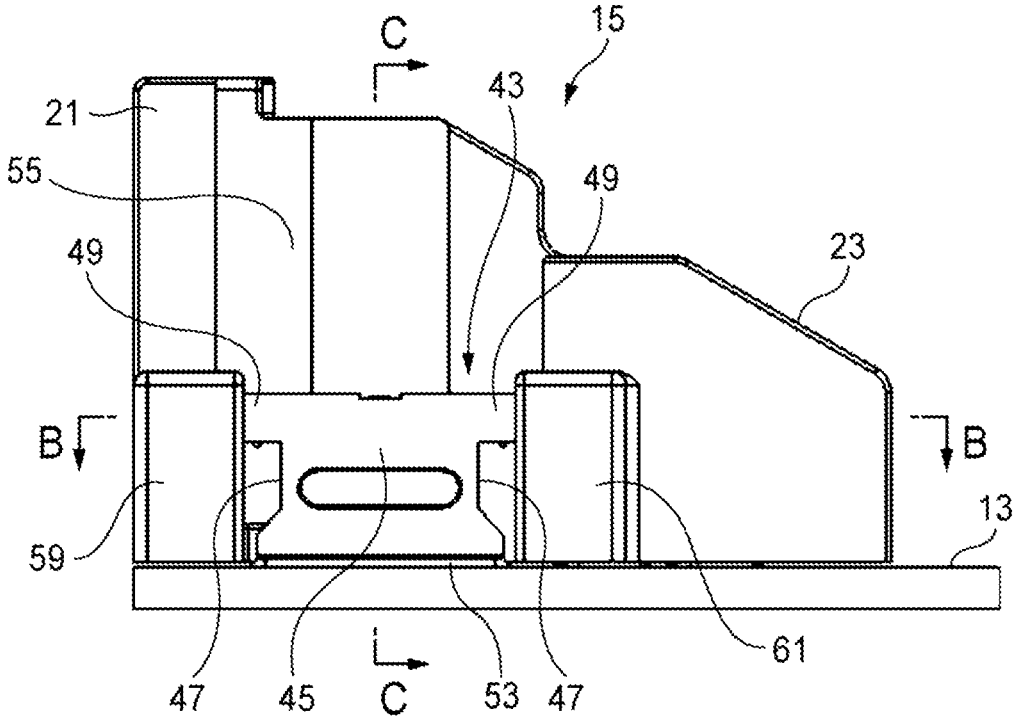
FIG. 5 is a side view of the board connector shown in FIG. 1.

To be specific, as shown in FIG. 5, in relation to the anchor hardware 43, the front-side upper lug 49 is press-fitted into the holding groove 57 of the front-side hardware fixing portion 59, and the rear-side upper lug 49 is press-fitted into the holding groove 57 of the rear-side hardware fixing portion 61.

Figure 7A:
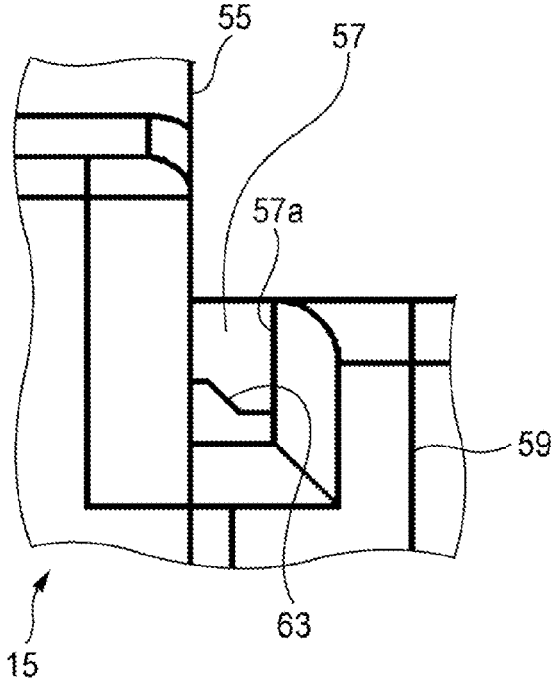
FIG. 7A is an enlarged plan view of a holding groove on one side of the press-fit attachment portion shown in FIG. 3.
Figure 7B:
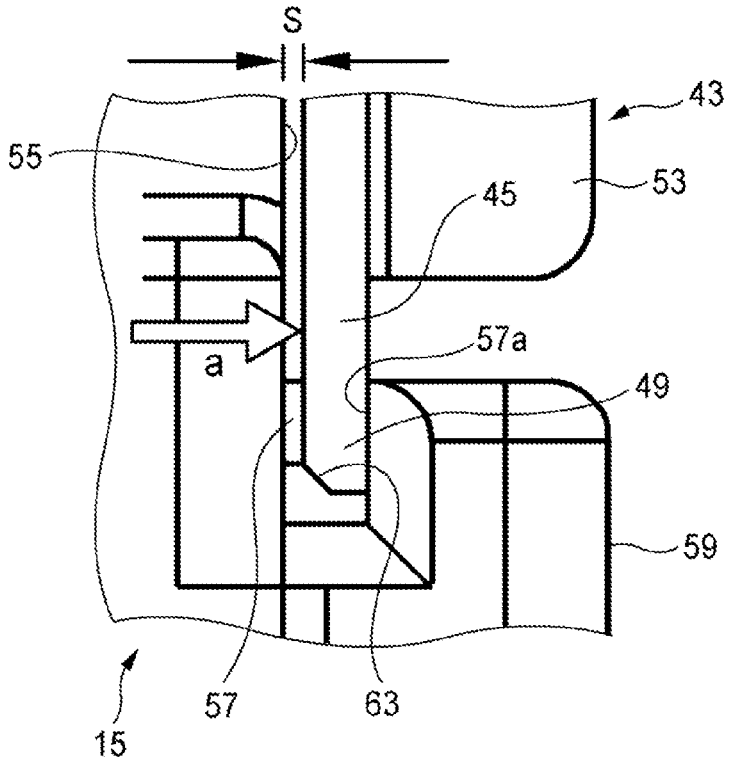
FIG. 7B is an enlarged plan view of the anchor hardware press-fitted into the holding groove shown in FIG. 7A.
Figure 8:
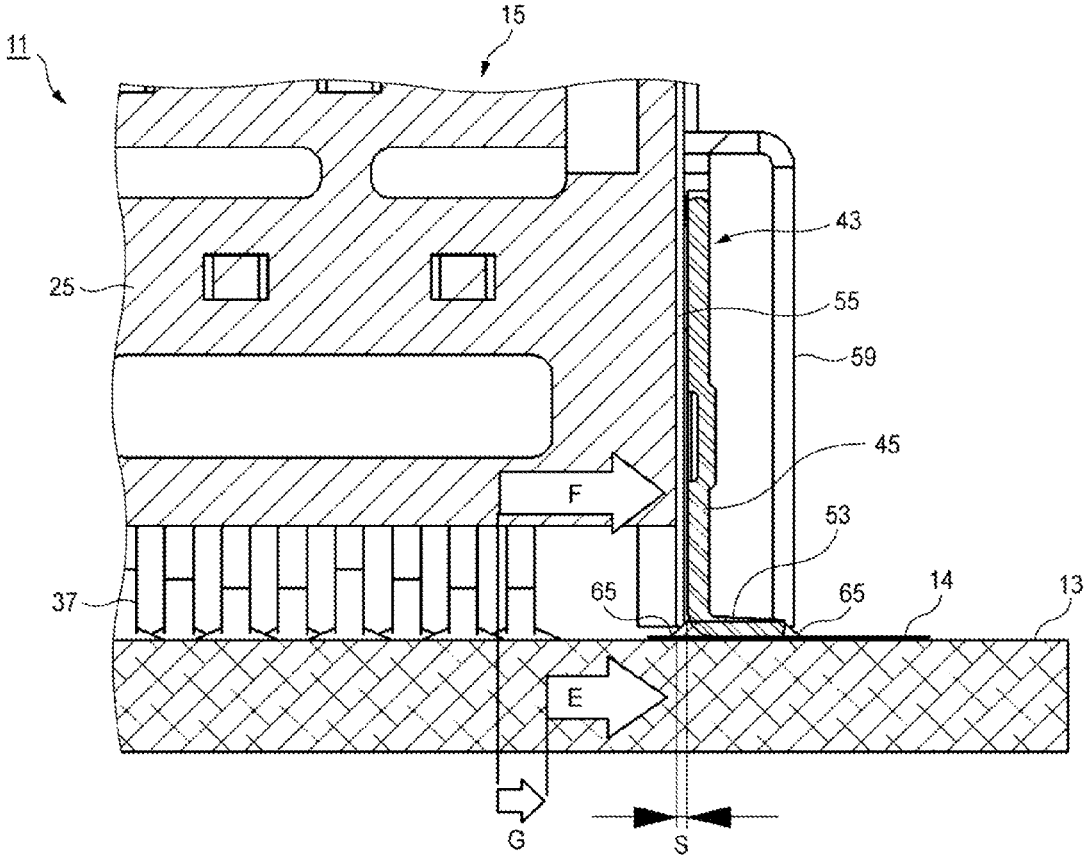
FIG. 8 is a cross sectional view taken along an imaginary line between arrowy heads C-C shown in FIG. 5.
Figure 9:
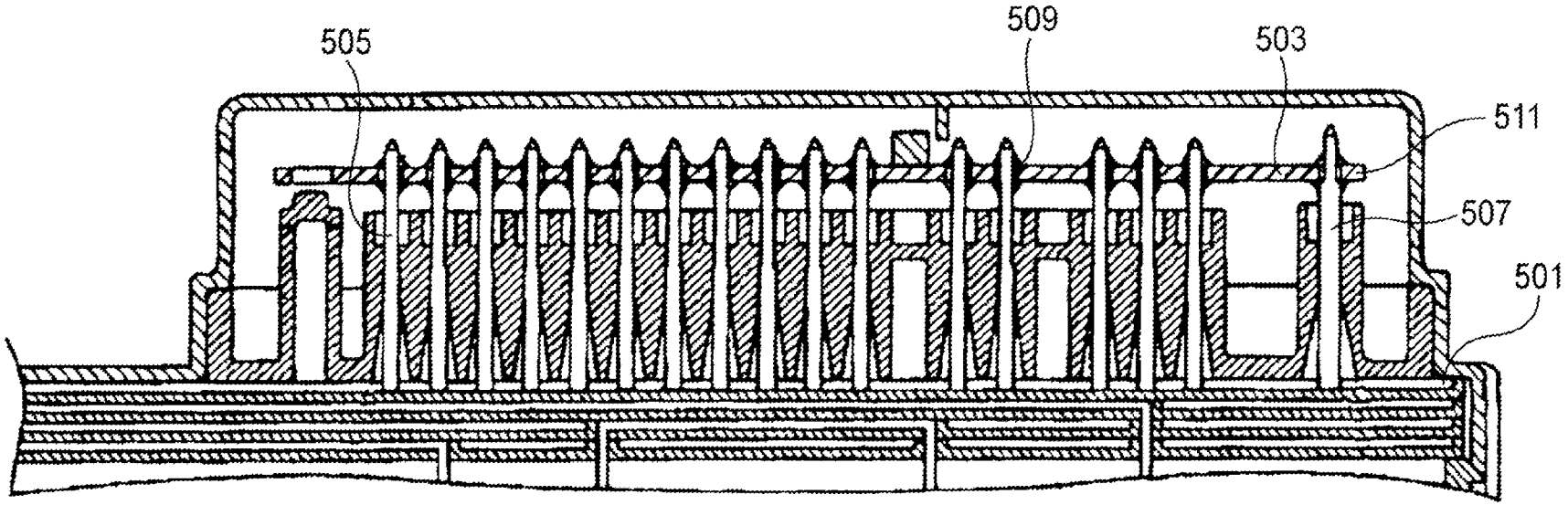
FIG. 9 is a cross sectional view showing that tabs of a flat bus bar and a conductor of a printed board in an electric connection box which utilizes a related-art technique for preventing cracking in solder.

As shown in FIGS. 7A and 7B, a tapered portion 63 for guiding a corresponding upper lug 49 of the press-fitted anchor hardware 43 in a direction "a" (see FIG. 7B) away from either side surface 55 of the connector housing 15 is formed in the holding groove 57 of the front-side hardware fixing portion 59 and the holding groove 57 of the rear-side hardware fixing portion 61, respectively. The tapered portions 63 work so as to guide the upper lugs 49 of the anchor hardware 43 to be press-fitted into the holding grooves 57 in the direction away from the either side surface 55 (a direction in which the upper lugs 49 are pushed against an outside interior wall surface 57*a* of each holding groove 57), thereby creating clearance S (see FIG. 7B) between the main body 45 of the anchor hardware 43 and each side surface 55 of the connector housing 15.

Operation of the board connector 11 having the above configuration is now described.

In the board connector 11 of the embodiment, when the upper lugs 49 of the anchor hardware 43 are press-fitted into the press-fit attachment portions 58 provided on either side surface 55 of the connector housing 15, as shown in FIG. 7A the anchor hardware 43 is guided (deviated), press-fitted, and held by the tapered portions 63 of the respective holding grooves 57 in the direction "a" away from either side surface 55 of the connector housing 15.

To be specific, the anchor hardware 43 is press-fitted and held in the connector hosing 15 while thoroughly separated from either side surface 55 of the connector housing 15. Accordingly, even if an inflated dimension F of the connector housing 15 is larger than an inflated dimension E of the circuit board 13 and when dimensional changes commensurate with a resultant difference G occur in each side surface 55 of the connector housing 15 during the course of the solder anchor 53 of each of the pieces of anchor hardware 43 being soldered to the conductor 14 of the circuit board 13 to thereby populate the board connector 11 on the circuit board 13, the clearance S exists between each side surface 55 of the connector housing 15 and the main body 45 of each of the pieces of anchor hardware 43 and, hence, can absorb the dimensional changes commensurate with the difference G due to a discrepancy, which originates from temperature changes, between the coefficient of linear expansion of the circuit board 13 and the coefficient of linear expansion of the connector housing 15. As a consequence, loads can be prevented from being imposed, for reasons of thermal changes, directly on soldered areas (solder fillets) 65 between the conductor 14 of the circuit board 13 and the anchor hardware 43 in the connector housing 15.

Further, the pair of upper lugs 49 provided along the upper side of the main body 45 are taken as a press-fit portion of each of the pieces of anchor hardware 43 can keep a distance from the solder anchors 53 provided along the lower side of the main body 45. Accordingly, dimensional changes commensurate with the difference G due to a discrepancy, which originates from temperature changes, between the coefficient of linear expansion of the circuit board 13 and the coefficient of linear expansion of the connector housing 15 can be effectively absorbed by elastic deformation of the main body 45.

Consequently, in the board connector 11 of the embodiment, the loads induced by thermal changes in the connector housing 15 will not be imposed directly on the soldered areas 65 of the anchor hardware 43, so that anchoring reliability of the anchor hardware 43 can be enhanced.

The invention is not limited to the foregoing embodiment and is susceptible, as required, to alterations, modifications, and the like. In addition, the constituent elements are not restricted and arbitrary in terms of materials, shapes, dimensions, quantities, layouts, and the like, so long as the invention can be accomplished.

The present application is based on Japanese Patent Application No. 2012-192360 filed on Aug. 31, 2012, the entire content of which is incorporated by reference herein.

The invention claimed is:

1. A board connector comprising:

a connector housing to be populated on a circuit board;

anchor hardware for soldering the connector housing to the circuit board;

a press-fit attachment portion that is formed on either side surface of the connector housing and that enables press-fitting and holding a press-fit portion of the anchor hardware; and a tapered portion that is formed in the press-fit attachment portion and that guides the press-fit portion of the press-fitted anchor hardware in a direction away from the side surface of the connector housing, thereby creating clearance that is maintained between the anchor hardware and opposing side surface of the connector housing.

2. The board connector according to claim 1, wherein the anchor hardware has a flat main body, a pair of upper lugs each of which is taken as the press-fit portion by causing an upper side of the main body to protrude in a widthwise direction, and a solder anchor made by folding a lower side portion of the main body in a thicknesswise direction of a plate;

the press-fit attachment portion is made up of a pair of holding grooves that extend in a direction orthogonal to an upper surface of the circuit board in order to press fit and hold the pair of upper lugs and that open while opposing each other; and the tapered portion formed in each of the respective holding grooves guide each of the upper lugs in a direction in which the upper lugs are pushed against an outside inner wall surface.

* * * * *